US005562343A

United States Patent [19]

Chan et al.

[11] Patent Number: 5,562,343

[45] Date of Patent: Oct. 8, 1996

[54] MULTIFUNCTIONAL RECESSED LIGHTING FIXTURE

[75] Inventors: Kingsley Chan, Providence, R.I.; Neil Russo, Howell; Andreas Pericleous, Colonia, both of N.J.

[73] Assignee: Lightolier Division of the Genlyte Group Incorporated, Union, N.J.

[21] Appl. No.: 323,368

[22] Filed: Oct. 14, 1994

[51] Int. Cl.[6] ..... F21S 3/02

[52] U.S. Cl. ..... 362/365; 362/147; 362/269; 362/364; 362/372

[58] Field of Search ..... 362/147, 269, 362/287, 364, 365, 371, 372, 404, 427

[56] References Cited

U.S. PATENT DOCUMENTS

| | | | |
|---|---|---|---|
| 2,757,818 | 8/1956 | Chamberlain . | |
| 2,842,281 | 7/1958 | Chisholm . | |
| 3,057,993 | 10/1962 | Gellert . | |
| 3,609,346 | 9/1971 | Lund | 362/364 |
| 3,749,873 | 7/1973 | Harper et al. . | |
| 4,459,648 | 7/1984 | Ullman | 362/404 |
| 4,745,533 | 5/1988 | Smerz | 362/364 |
| 4,751,624 | 6/1988 | Russo et al. . | |
| 4,754,377 | 6/1988 | Wenman | 362/364 |
| 5,130,914 | 7/1992 | Bengochea | 362/147 |

*Primary Examiner*—Denise L. Gromada
*Assistant Examiner*—Y. Quach
*Attorney, Agent, or Firm*—Hopgood, Calimafde, Kalil & Judlowe

[57] ABSTRACT

A multifunctional recessed lighting fixture which offers a unique combination of modular parts and unit components which can be assembled in a plurality of possible variations resulting in distinctive appearance of the variants assembled, yet maintaining an appearance of continuity among the recessed lights.

5 Claims, 16 Drawing Sheets

MULTIFUNCTIONAL RECESSED LIGHTING FIXTURE

BACKGROUND OF THE INVENTION

1. Field of Invention

The present invention relates to recessed lighting fixtures. More particularly, the present disclosure describes a multifunctional recessed lighting fixture comprised of a variable combination of modular parts and unit components which are assembled in a plurality of possible variations resulting in distinctly different products while maintaining continuity in appearance among the diverse assembled recessed lighting options.

2. Description of the Related Art

Devices for facilitating the attachment of lighting fixtures to suspended ceilings are available in the art. For instance, U.S. Pat. No. 3,420,995 describes a latching mechanism, U.S. Pat. No. 3,597,889 describes a junction box, and U.S. Pat. No. 4,041,657 describe a support, all for use with lighting fixtures in suspension ceilings. Recessed lighting fixtures are also known in the art. For example, U.S. Pat. Nos. 4,408,262, 4,039,822, 4,086,480 and 4,646,212 all describe recessed lighting fixtures for suspension ceilings.

The typical ceiling-mounted, recessed lighting fixture is comprised of a frame with means for securing the frame to structural supports of the ceiling. For installation, the frame of the lighting fixture includes holes or brackets through which fasteners are used to position and attach the fixture to the supports. The standard suspended ceiling is a metal gridwork, spaced a fixed distance apart from the overhead structure. For attachment to the gridwork, the frame of the lighting fixture is usually provided with guideways for connection with the grid at a desired position.

Depending on building codes, architectural needs and specifier requirements, the ceiling environment for a specific lighting fixture application calls for a particular type of light source to be used in the fixture. For example, using an improper type or wattage of bulb can create hazards, such as an operating temperature higher than the fixture is able to accommodate for the specific environment. Different varieties of light sources such as incandescent, halogen, H.I.D. or fluorescent lamps also require diverse line voltage types and associated transformer and ballast categories. A need exists in the art for a versatile system which adapts to the wide variety of lighting needs within any particular ceiling environment.

Another problem with prior art devices is caused by the inflexibility and rigidity of the frame designs to adapt to different field requirements. Although metal grids, joists or other ceiling structures to which the lighting fixture is attached are intended to receive a range of recessed fixtures, that range is often limited depending on the type of frame used. As illustrations, installation of a device at a slight slope or in an awkward corner will prevent desired optics in that part of the room. The prior art fixtures often have a rigid, unchangeable frame geometry and must be mounted with undue care towards their relationship with the suspended ceiling or require another frame type altogether to obtain the preferred optics. Such excessive customized installation is somewhat contrary to cost limitations and often retards high quality, aesthetic work because contractors have to constantly keep the bid prices in mind.

Additionally, known recessed lighting fixtures are typically installed in hung ceilings with the socket harness electrically connected via a junction box located within the ceiling. The fixture's housing and accessories are usually, permanently installed within the ceiling structure. Installation of modifiers such as bulb socket harnesses, socket harness assemblies, reflector cones and other accessories for accentuating and diversifying the optical environment, necessitates obtaining access through awkward sites within the ceiling which becomes difficult because of limited space due to the ceiling structure, thermal insulation, electrical wiring and other conduits. Any modifications or adaptations to the available optics require that part of the ceiling be temporarily removed to allow access into the frame. Often the housing has to be dismounted to make such changes when there is limited free space immediately surrounding the housing.

A need exists for a lighting fixture having a constant frame with interchangeable, easily adaptable component assemblies which are mounted and exchanged with ease to suit the various lighting needs found in any given floor or wall space. In essence, known devices have a number of deficiencies regarding versatility to changing lighting requirements and-ease of installation of accessories to meet the different needs. A more efficient fixture design would not only facilitate installation, but also save interior design costs by reducing the number of different frames that must be purchased to meet the myriad of lighting needs required by specifiers.

Ceiling mounted, recessed fixtures are very widely used, in virtually every new construction operation, whether for residential or commercial use. Accordingly, significant costs savings may be achieved by reducing the variety and number of frame types required to complete a job. Thus, a need exists in the art for a unified system which adapts to the diversity of different optic requirements found even in the same room which is consistent with the economics of the intended use of mass-produced, easily installed lighting fixtures.

OBJECTS OF THE INVENTION

Accordingly, it is an object of this invention to provide a multifunctional recessed lighting fixture that is versatile and adaptable to the wide variety of lighting requirements within a particular space to be lighted.

Another object of this invention is to provide a multifunctional lighting fixture which avoids compromise in optics in any given design situation by utilizing a single housing shell assembly design with a plurality of interchangeable, easily adaptable component assemblies which are mounted and exchanged with ease to suit the various lighting needs found in any given floor and wall space.

A further object of this invention is to contribute a multifunctional fixture which provides a reduced requirement for different frame types for different optic needs, resulting in a savings in the costs of installation and maintenance.

Yet another object of this invention is to provide a more efficient fixture design which has flexibility in internal component assemblies for easy conversion from one type of fixture to another without extensive wiring, which solves most application and field problems, and which can be re-configured after installation to meet changing needs.

These and other objects will be apparent in the following description.

SUMMARY OF THE INVENTION

The present invention is a multifunction lighting fixture designed to be specifically assembled for or interchangeably converted to adjustable accent lighting, wallwasher lighting or downlighting.

The multifunction recessed lighting fixture comprises a housing shell having an aperture defined by a rim disposed in the shell, an interchangeable socket harness comprised of pre-wired detachable electric connections for mounting a first end of a lamp, an interchangeable lampholder assembly for mounting a second end of the lamp and an interchangeable reflector trim mounted to the shell through the aperture defined by the rim.

The socket harness and lampholder assembly are both detachably mounted in the housing shell, and the lampholder assembly has a lower member with a central opening through which passes the interchangeable reflector trim mounted to the shell through the aperture defined by the rim.

The interchangeable lampholder assembly can have an off-setting mechanism comprised of a lamp-holding member designed to hold the center of a beam of light from the lamp offset laterally from the physical center of the reflector trim. The interchangeable lampholder assembly can further comprise a circular horizontal member having a horizontal cam which is capable of 358 degrees of rotational adjustment for the lamp mountable to the lampholder. The horizontal cam is lockable at any point of the 358 degrees of horizontal rotation.

The interchangeable lampholder assembly can also have a vertical pivot mechanism comprised of a vertical cam lock which allows from 0 to about 45 degrees of vertical tilt adjustment for the lamp mountable to the lampholder assembly. The interchangeable reflector trim is a cone having a first and a second circular openings, the first circular opening being truncated, with the interchangeable lampholder assembly having an offsetting mechanism comprised of a lamp-holding member designed to hold the center of a beam of light from the lamp offset laterally from the physical center of the cone. In such a setup, the lampholder assembly further comprises a vertical pivot mechanism having a vertical cam lock which allows from 0 to about 45 degrees of vertical tilt adjustment for the lamp such that maximum beam of light passes through the truncated, first opening when the adjustment is at a vertical angle of 0 degrees and maximum beam of light passes the second opening when the adjustment is at a vertical angle of 45 degrees.

The lampholder assembly can be further comprised of a U-shape member having at least one U-shape groove disposed therein, with the at least one groove having at least one tension spring means for interchangeable engagement with a component such as a lamp, a lamp ring, a screen, a color filter, a louvre, a lens or combinations thereof.

The circular horizontal member of the lampholder assembly is further comprised of at least one notch and the interchangeable reflector trim comprises at least one tension spring for engagement with the notch. A plurality of notches can be made in the horizontal member with a like number of counterpart springs in the reflector trim for selective engagement.

In another embodiment the lampholder assembly is further comprised of a circular member having at least two downward extending tension spring means for interchangeable engagement with a component such as a lamp, a lamp ring, a screen, a color filter, a louvre, a lens or combinations thereof.

The multifunction recessed lighting fixture can also be configured for use as a wallwasher which comprises a housing shell having an aperture defined by a rim disposed therein, an interchangeable socket harness for mounting a first end of a lamp, the socket harness comprised of pre-wired detachable electric connections, the socket harness detachably mounted in the housing shell with an interchangeable lens wallwasher reflector trim mounted to the shell through the aperture defined by the rim.

The wallwasher embodiment can have a lens wallwasher reflector trim further comprised of a U-shape member having at least one tension spring means for interchangeable engagement with a lamp, said U-shape member providing unobstructed access for easy side relamping.

BRIEF DESCRIPTION OF THE DRAWINGS

FIG. 3B depicting a front view of the U-shaped holder embodiment with a cut-away view of the horizontal cam lock;

FIGS. 3C and 3D giving side views of the embodiment shown in FIG. 3B, with a cut-away view of the horizontal cam and aspects of the vertical cam lock seen from lines 3C—3C and 3D—3D in FIG. 3B, respectively;

FIG. 3E showing an isolated side view of the vertical cam lock with the tilt mechanism depicted with a vertical member shown superimposed in phantom lines;

FIG. 3F showing a bird's-eye view of the vertical cam lock seen from line 3F—3F in FIG. 3E;

FIG. 3G depicting an isolated side view of the horizontal cam lock;

FIG. 3H showing a cut-away view of an isolated portion of the horizontal cam lock seen from line 3H—3H in FIG. 3G;

FIG. 3I showing a bird's-eye view of the horizontal cam lock seen from line 3I—3I in FIG. 3G; and FIG. 3J showing another embodiment of the lampholder assembly having downwardly-extending springs with an additional depiction of a thumb screw lock drawn in phantom lines.

Also depicted is a connection between the electric power converter and a junction box for this low voltage embodiment.

Figure 5B:
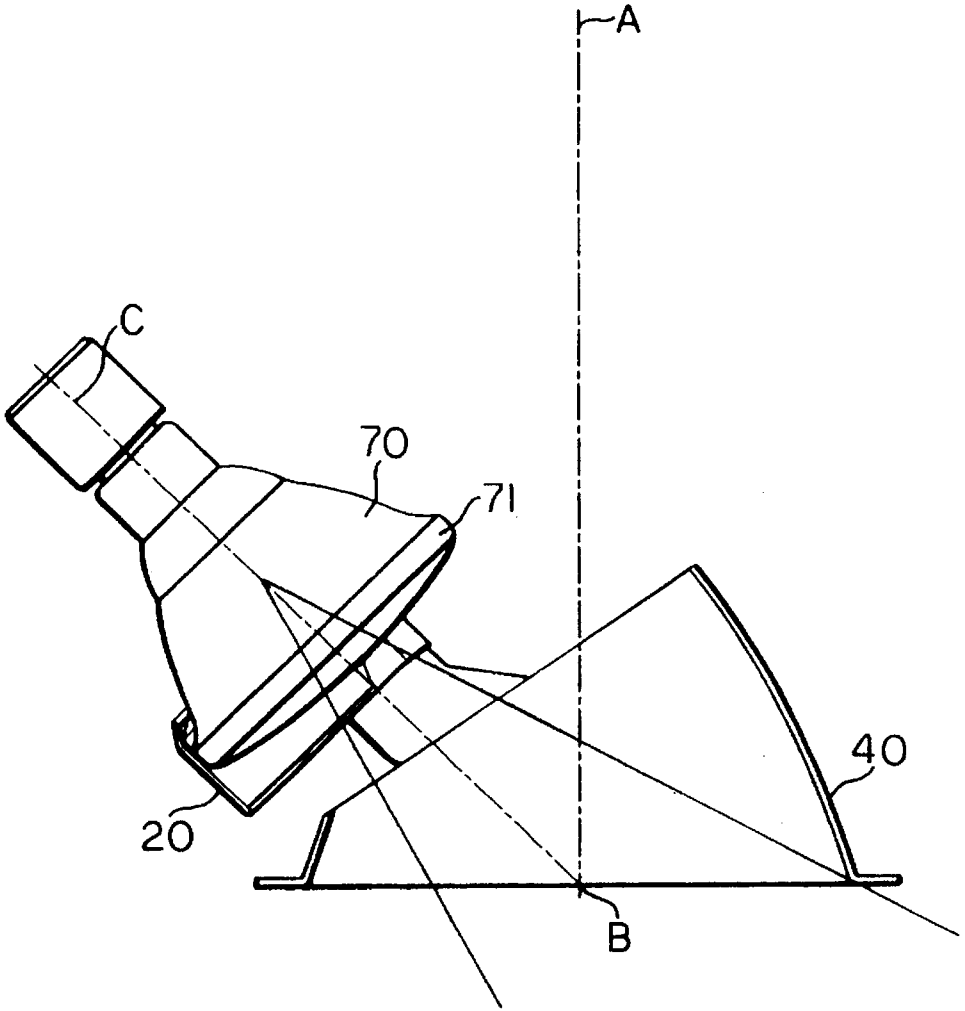
Figure 5A:
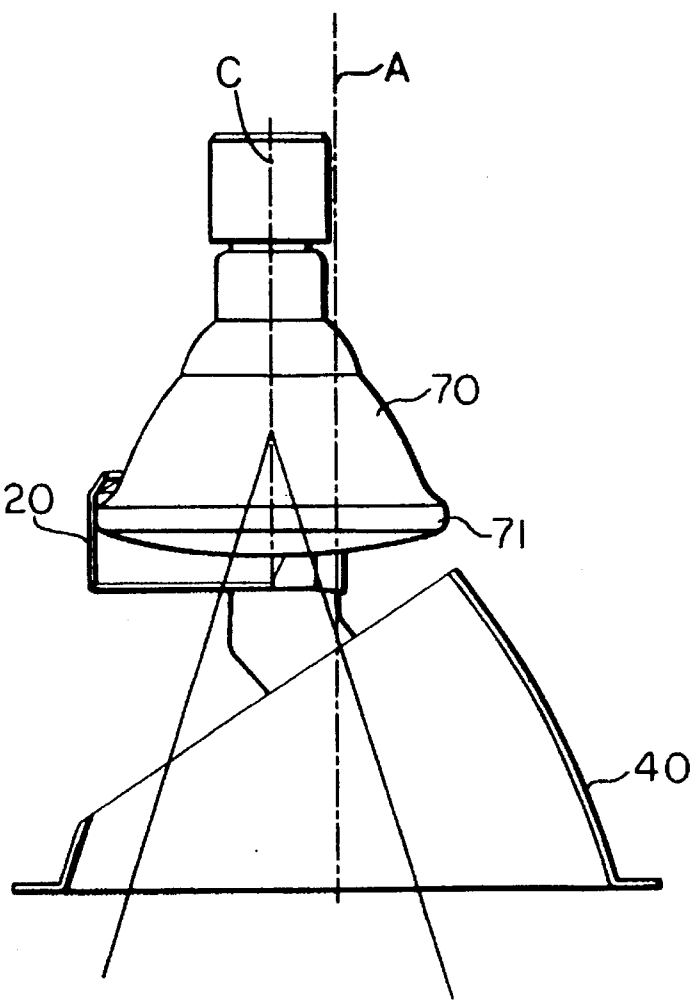

FIG. 5A illustrates the offset pivot mechanism provided by the present invention depicting offset relationships between the physical center of the reflector cone and the center of the lamp source.

FIG. 5B shows a 45° pivot angle which centers the lamp source at the center of the lower circular opening of the truncated reflector cone.

Figure 6A:
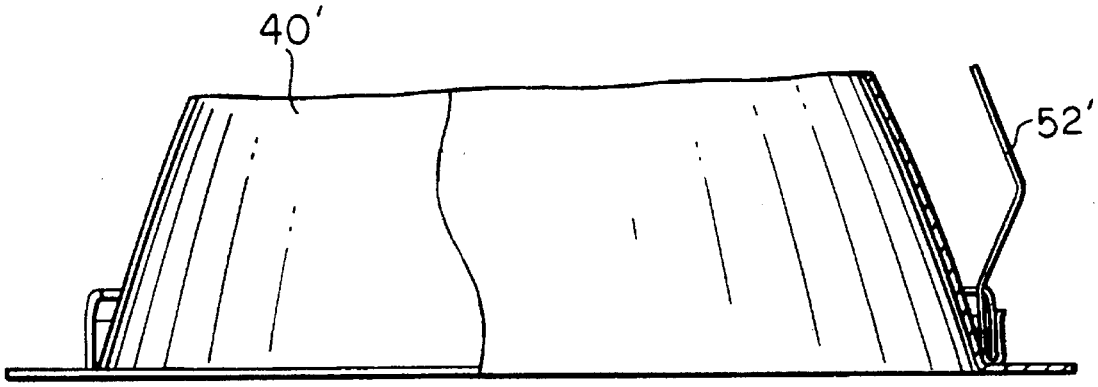
Figure 6B:
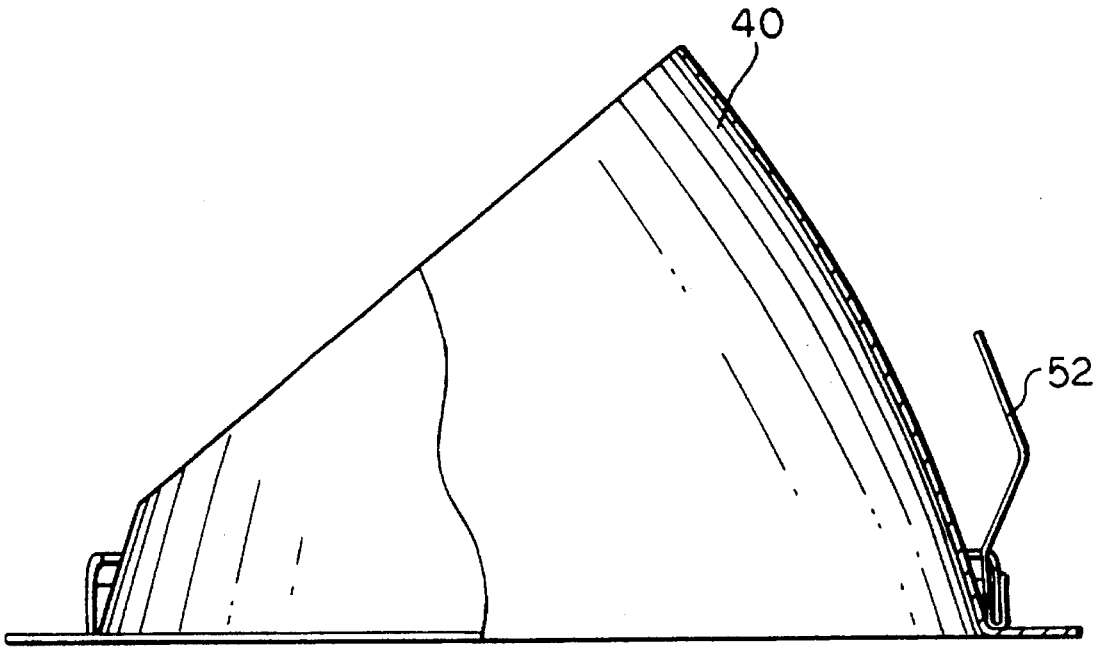

FIGS. 6A and 6B show a cone reflector and a truncated cone trim, respectively.

Figure 7A:
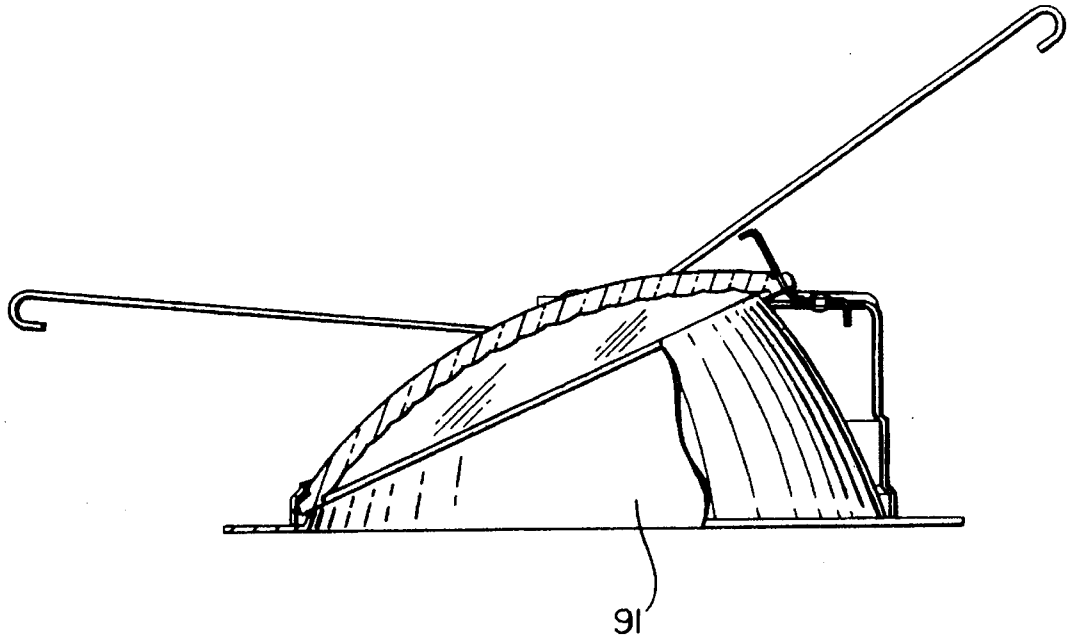
Figure 7A:
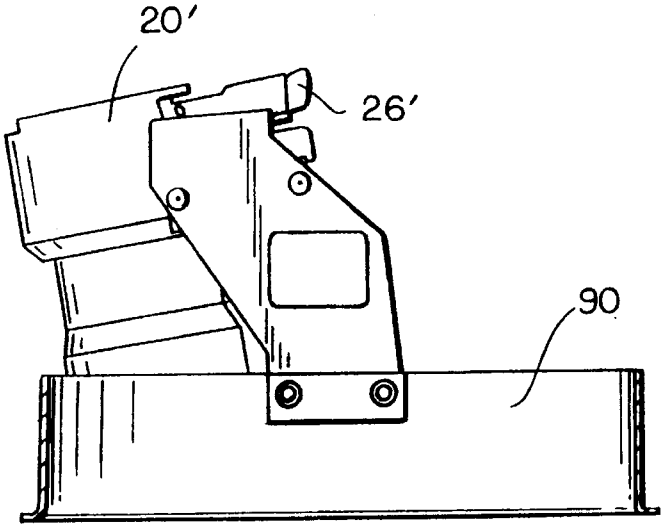
Figure 7B:
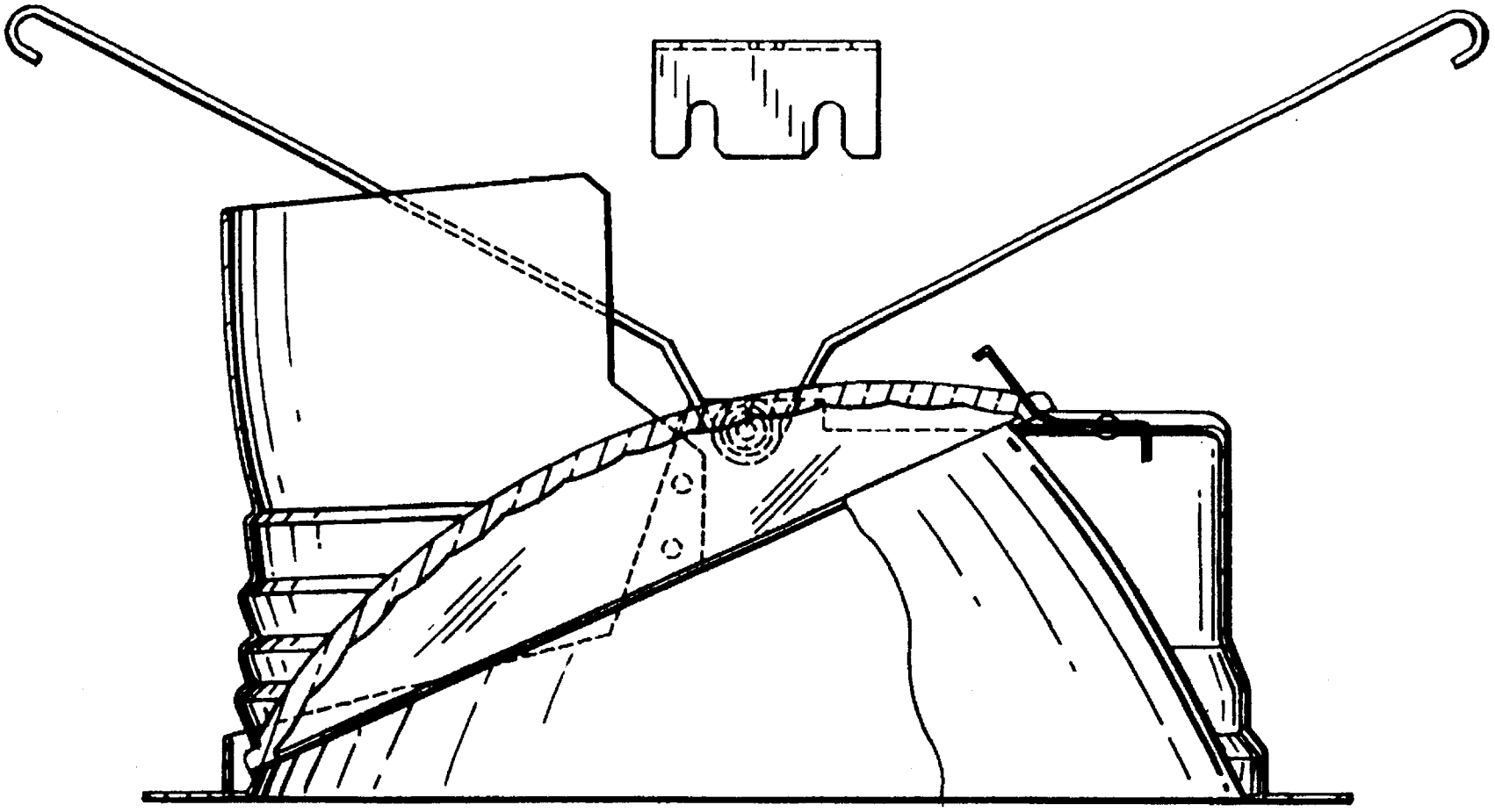

FIG. 7A shows two components of a specialized lens wallwasher reflector trim, and FIG. 7B shows an integrated lens wallwasher reflector trim.

Figure 8:
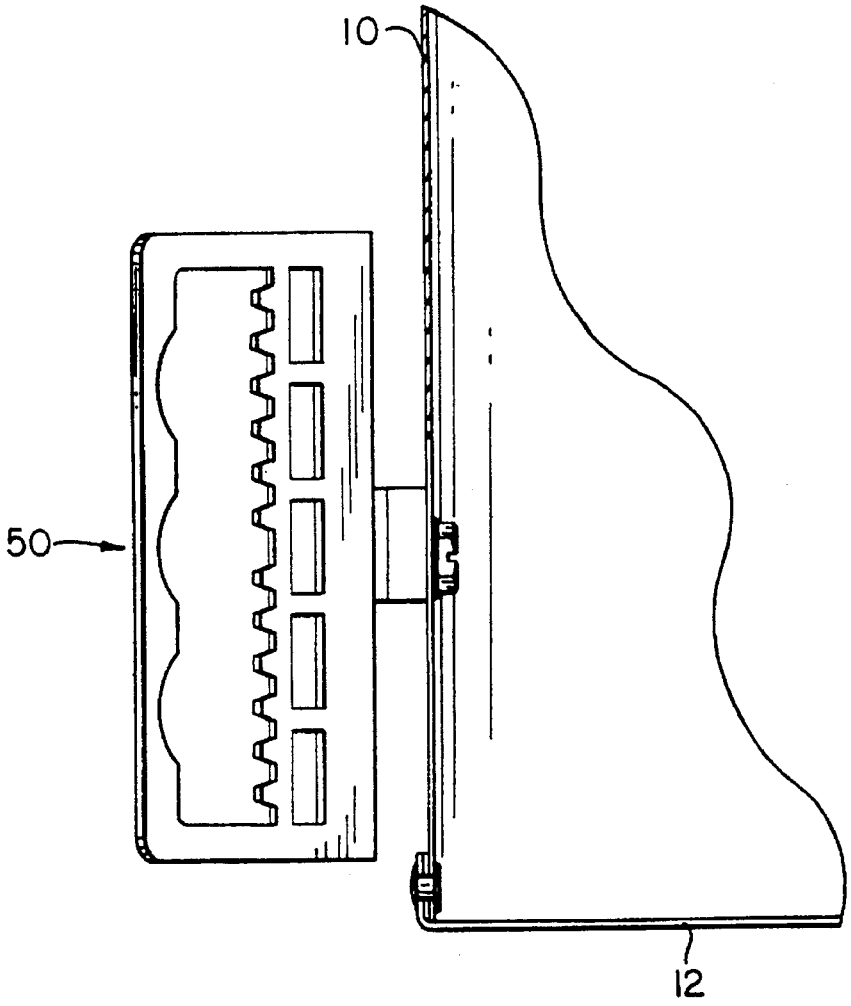

FIG. 8 depicts a mounting bracket attached to a cut-away portion of a shell housing, showing access to the bracket available from the inside as well as from outside of the shell.

Figure 9:
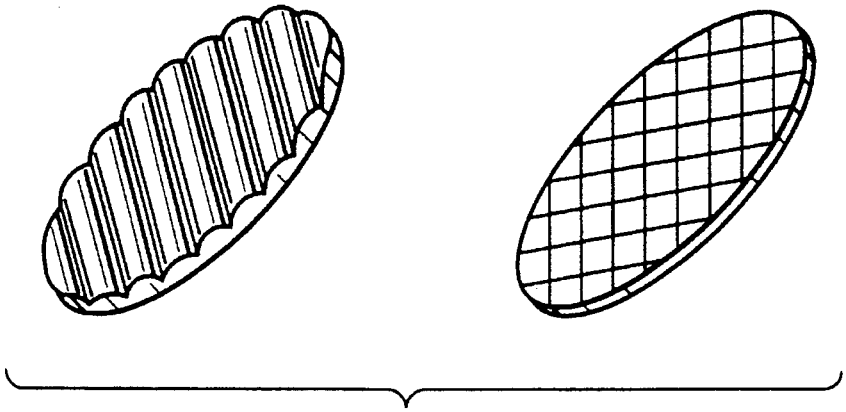

FIG. 9 shows two accessories, specifically a wire mesh screen and a tinted glass filter.

DETAILED DESCRIPTION OF THE INVENTION

The preferred multifunctional lighting fixture consists of five primary component assemblies, namely, (i) the housing shell, including a mounting frame, (ii) the lampholder assembly, including a novel vertical and horizontal cam locking mechanism, (iii) the lamp socket harness assembly, (iv) the reflector trim options, and (v) the electric power converter.

Everything is modular with respect to the housing shell, including the electric power converter types which include transformers or ballasts, different socket harness assemblies, reflector trim options and accessories such as lenses, louvers, screens and color filters. Substantially all modular parts snap-in and snap-out and the electrical connections within the system are made via prewired plugs eliminating the need for hard wiring.

For example, in a wallwasher version, the lampholder assembly is unnecessary and the reflector is a specialized trim having a wallwasher lens and holder. In another example, the novel vertical and horizontal cam locking mechanism may not be required for a downlighting version, and in such an embodiment a relatively simpler lampholder is sufficient.

Thus, a recessed fixture required for a particular job or to address a specific lighting problem is assembled from modular, interchangeable components. One housing shell can be converted into a variety of products such as adjustable accent lighting, wallwasher lighting or downlighting, and fitted with a lamp source compatible to low-voltage or line-voltage, or can be a metal-halide type, with appropriate transformers where necessary.

The preferred housing shell is constructed primarily from rolled and die-formed steel with a heat-dissipating aluminum cover. In the preferred embodiment, the housing shell comprises at its uppermost portion a removable top for relamping or other internal adjustments, and at its lowermost portion, a mounting frame constructed primarily from die-cast aluminum suitable for attachment to dry or poster ceilings.

All substrate materials mentioned in this disclosure are provided as exemplary embodiments. Other suitable substrates are well known to those skilled in the art, and all such alternatives are considered within the scope of this disclosure.

In the interior of the shell is detachably disposed a socket harness assembly which holds an upper end of a lamp. In the preferred embodiment, the lamp is also mounted at its lower end to a lampholder assembly. The lamp can be an incandescent source, fluorescent, HID or other types suitable for recessed lighting known to those skilled in the art. The lower end of the shell is comprised of a mounting frame which defines a circular aperture substantially at its center. The mounting frame allows installation of the fixture to a ceiling and the aperture is designed for mounting reflector trims for directing passage of light from the lamp to its target. The aperture through the reflector trim is also convenient for relamping and internal adjustments from a position below the shell once it is mounted to a ceiling.

In one embodiment, the lampholder assembly is primarily of die-cast aluminum and comprises a "U" or "horse-shoe" shaped member. In the preferred embodiment, there are two, tandem U-shaped members, one for use as a lamp ring or lamp holder and the other for use as an accessory holder. Each U-shaped member is provided with at least one die-formed steel tension spring disposed within a U-shaped groove for easy snap-in and snap-out, side mount relamping and for attachment of various accessories. The novel horse-shoe shape of the holder provides unobstructed access for easy side relamping without adjusting focus at any angle of adjustment, especially from a position below and through the lower end of the housing. The novel horse-shoe shape also provides unobstructed access for top, side relamping without the need for re-adjustments to focus if the ceiling allows such access through the upper end of the housing.

In another embodiment, the lampholder assembly is also comprised of a novel off-set pivot mechanism for proper beam alignment and includes the use of single-action horizontal and vertical cam locks and a truncated cone reflector. The locking mechanisms allow for up to 45 degrees of vertical tilt adjustment and 358 degrees of horizontal rotational adjustment. Both such adjustments once made, remain locked while relamping. Preferably, both the horizontal and vertical locks are operated with finger locking knobs.

The vertical lock is preferably a die-cast aluminum lever for providing cam action vertical adjustment and lock. The horizontal lock is preferably a spring steel lever for providing cam action horizontal adjustment and lock. The offset centering pivot mechanism permits exactly centered beam direction, even at angles of up to 45 degrees for adjustable accent lighting. The two easy-to-engage cams hold the lampholder in place to focus the light beam where aimed and relamping does not effect the focus once the cams are locked after adjustment. To facilitate delivery of maximum centered beam to a highlighted area, a truncated cone trim is utilized.

In another embodiment, the lampholder assembly comprises a circular-shaped holder provided with plurality of downwardly extending die-formed steel tension springs for easy snap-in, snap-out mounting and relamping of lamps, lamp rings and accessories. The springs also hold and center the lamp to the aperture at the lower end of the housing shell. In the adjustable version of this embodiment, a thumbscrew is suitable for lamp beam direction adjustments.

The lamp socket harness assemblies comprise in one embodiment a ring for holding the lamp (usually of a relatively smaller size) and a socket which are preferably of porcelain and pre-wired with leads to a plastic plug-in connector for easy snap-in/snap-out electrical connection to a power source or to an intermediary converter. A high temperature plastic plug-in socket can be readily substituted to achieve comparable results. The socket harness assemblies are of various designs dependent on the type and size of the lamp to be held. For instance, if the lamp has a rim of a size that can be snapped directly into the lampholder assembly, no ring is required.

The reflector options include cones, truncated aperture cone trims, modified wallwasher versions or specialized downlighting adaptations, and are preferably made substantially of aluminum. In production, these trims can be specular clear, gold or black anodized, self flange polished or painted matte white. Other suitable colors or constituents are known to the skilled artisan in the recessed lighting field.

The component assemblies described are combined to form a variety of final products which are individually adaptable for use in virtually any portion of a recessed ceiling. Once in place, the multifunction recessed fixture provides lighting suitable and aesthetically pleasing for that particular area. The myriad of possible features provided herein are able to meet the specifications for practically any recessed lighting problem. The result is a very flexible product that can easily be converted from one type of light source to another with ease, internally at the manufacturing level or externally at the job site.

Figure 1:
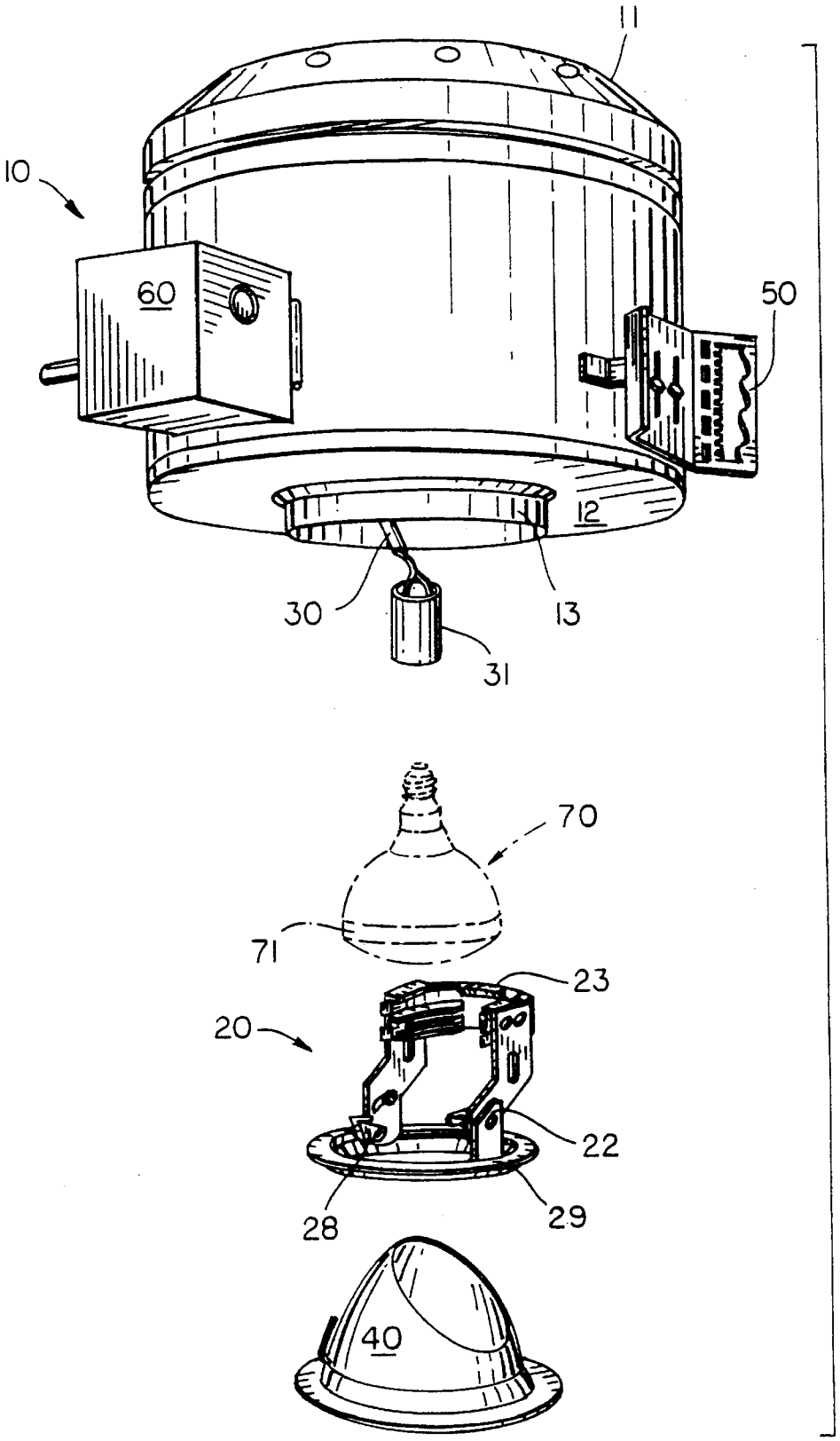
FIG. 1 is an exploded, perspective view of one embodiment of the present invention showing the housing shell, lampholder assembly and reflector trim. A portion of the socket harness assembly is seen extending through the aperture in the bottom portion of the housing shell.

Referring to FIG. 1, several primary component assemblies of the preferred multifunctional lighting fixture are shown. Specifically, FIG. 1 shows an exploded view of the housing shell 10, lampholder assembly 20 and reflector trim 40. A portion of the socket harness assembly 30 is shown extending through the aperture defined by rim 13 of mounting frame 12 at the bottom portion of housing shell 10.

FIG. 1 shows the preferred housing shell 10 which is constructed primarily from rolled and die-formed steel with a heat-dissipating aluminum cover 11. Located at the uppermost portion of shell 10, cover 11 is removable to allow for relamping or other internal adjustments from the top. Located on the external surface of shell 10 is mounting bracket 50 and junction box 60.

Defining the lowermost portion of shell 10 is mounting frame 12 constructed primarily from die-cast aluminum suitable for attachment to dry or poster ceilings. The circular aperture defined by rim 13 of mounting frame 12 is designed to snugly fit truncated reflector cone 40 in the fully assembled apparatus. Reflector cone 40 is also designed to fit into the circular opening defined by circular horizontal member 29 on lampholder assembly 20. Socket 31 of harness assembly 30 will hold lamp 70 which in turn will be held by lampholder assembly 20 via lamp rim 71. Lampholder assembly 20 includes a vertical cam locking mechanism 22 and a horizontal cam locking mechanism 28.

Lamp 70 can be an incandescent source, fluorescent or HID, and an electric power converter can easily be mounted onto bracket 50 based on the need of the particular lighting situation. The aperture defined by mounting frame rim 13 provides access through the lower end of shell 10 for mounting reflector trims such as cone 40. Once mounted, the circular opening in cone 40 provides for passage and exit of light from lamp 70 to its target. The roomy aperture through cone 40 is also convenient for relamping and internal adjustments from a position below shell 10 once it is disposed in the ceiling.

Figure 2:
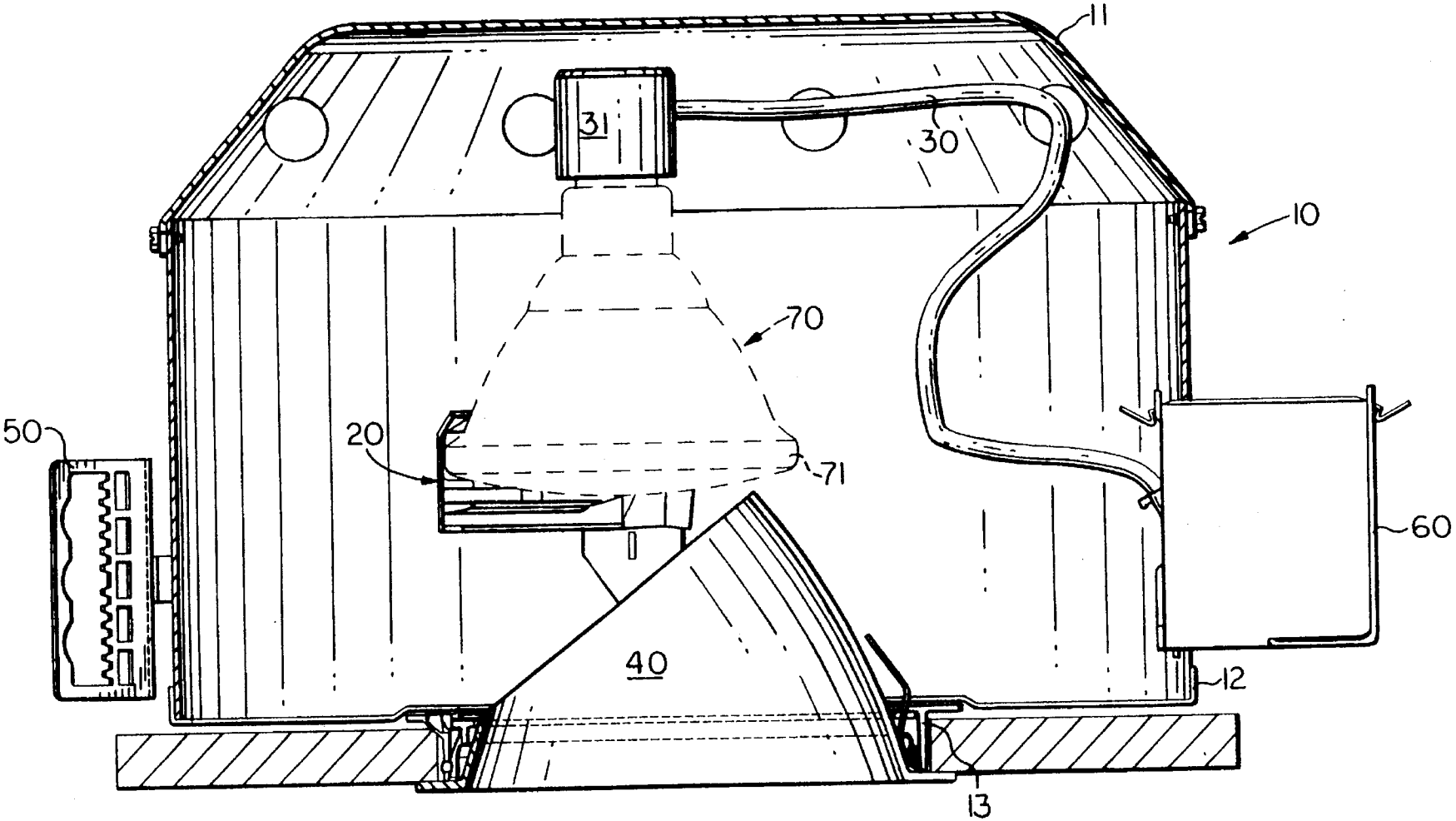
FIG. 2 is a cut-away, side view of a housing shell showing attachment of a junction box and a mounting bracket on the external surface of the shell and an internal view showing the lampholder and socket harness assemblies in operating position.

FIG. 2 shows a cut-away, side view of an assembled multifunctional lighting fixture. Viewed in conjunction with the exploded perspective view of FIG. 1, FIG. 2 illustrates the modular nature of the primary components with respect to housing shell 10. Socket harness assembly 30, lamp 70 (shown in phantom lines), lampholder assembly 20 and reflector trim option 40 are interchangeable with types other than the ones depicted.

Figure 4A:
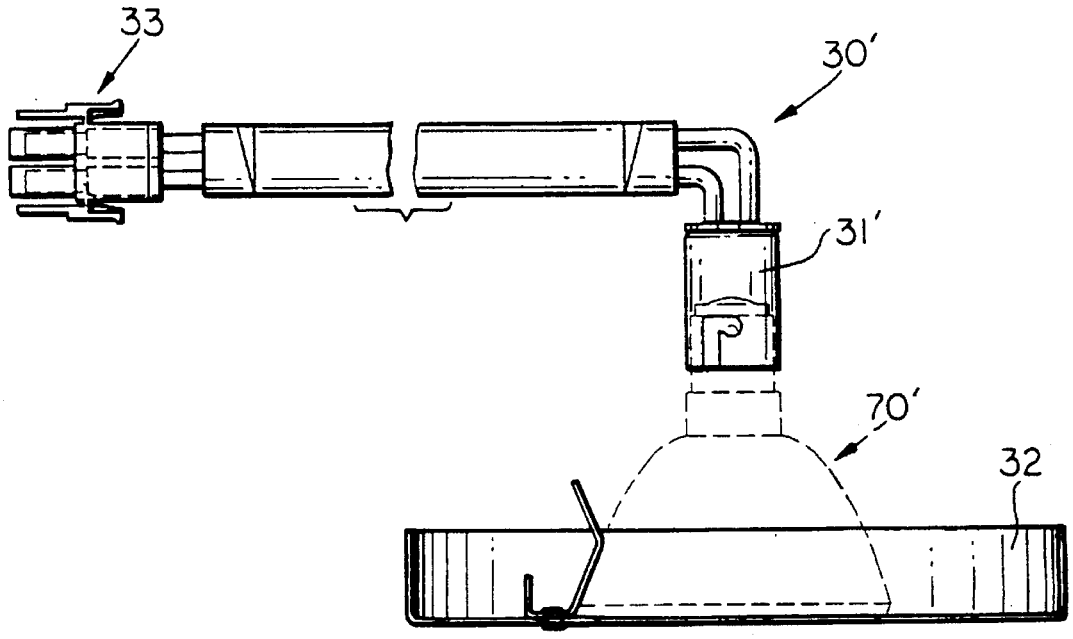
FIG. 4A shows one embodiment of the socket harness assembly having a ring holder in which is held a low voltage lamp drawn in phantom lines. Attached to the socket holding the lamp are pre-wired leads joined to a plastic snap-in/snap-out electrical connection which are designed to connect to an electric power converter (not shown).
Figure 4B:
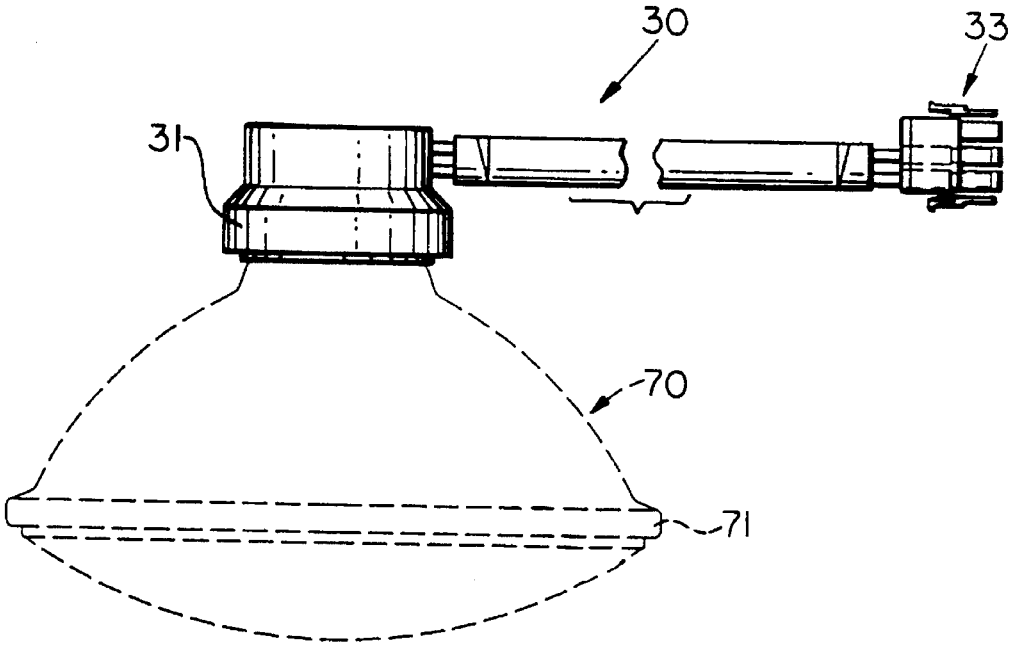
FIG. 4B shows another embodiment of the socket harness assembly with a socket shown holding a lamp which has a rim size suitable for direct snap into a lampholder assembly. No ring holder is required and the snap plugs connect to a junction box (not shown) for direct line-voltage.

For example, FIG. 4A shows one embodiment of a socket harness-30' which has a ring holder 32 for holding a low voltage lamp 70' drawn in phantom lines. Socket harness 30' is essentially a pre-wired lead joined to plastic snap-in/snap-out electrical connection 33 which is designed to connect to an electric power converter. FIG. 4B shows another embodiment of socket harness assembly 30 with socket 31 shown holding lamp 70 (drawn in phantom lines) which has a rim 71 of a size suitable for direct snap-in to a lampholder assembly, requiring no ring holder.

FIG. 2 shows the interior of shell 10 in which is detachably disposed lampholder assembly 20. Lampholder assembly 20 is connected to socket harness assembly 30 via lamp 70 (shown in phantom lines) of the type illustrated in FIG. 4B. Lamp 70 is engaged at its lowermost portion to lampholder assembly 20 via rim 71 and engaged at its uppermost portion to socket harness assembly 30 in socket 31. In the embodiment shown in FIG. 2, socket harness 30 has electrical connection directly to junction box 60 via snap plugs (not shown) for direct line-voltage.

Figure 4C:
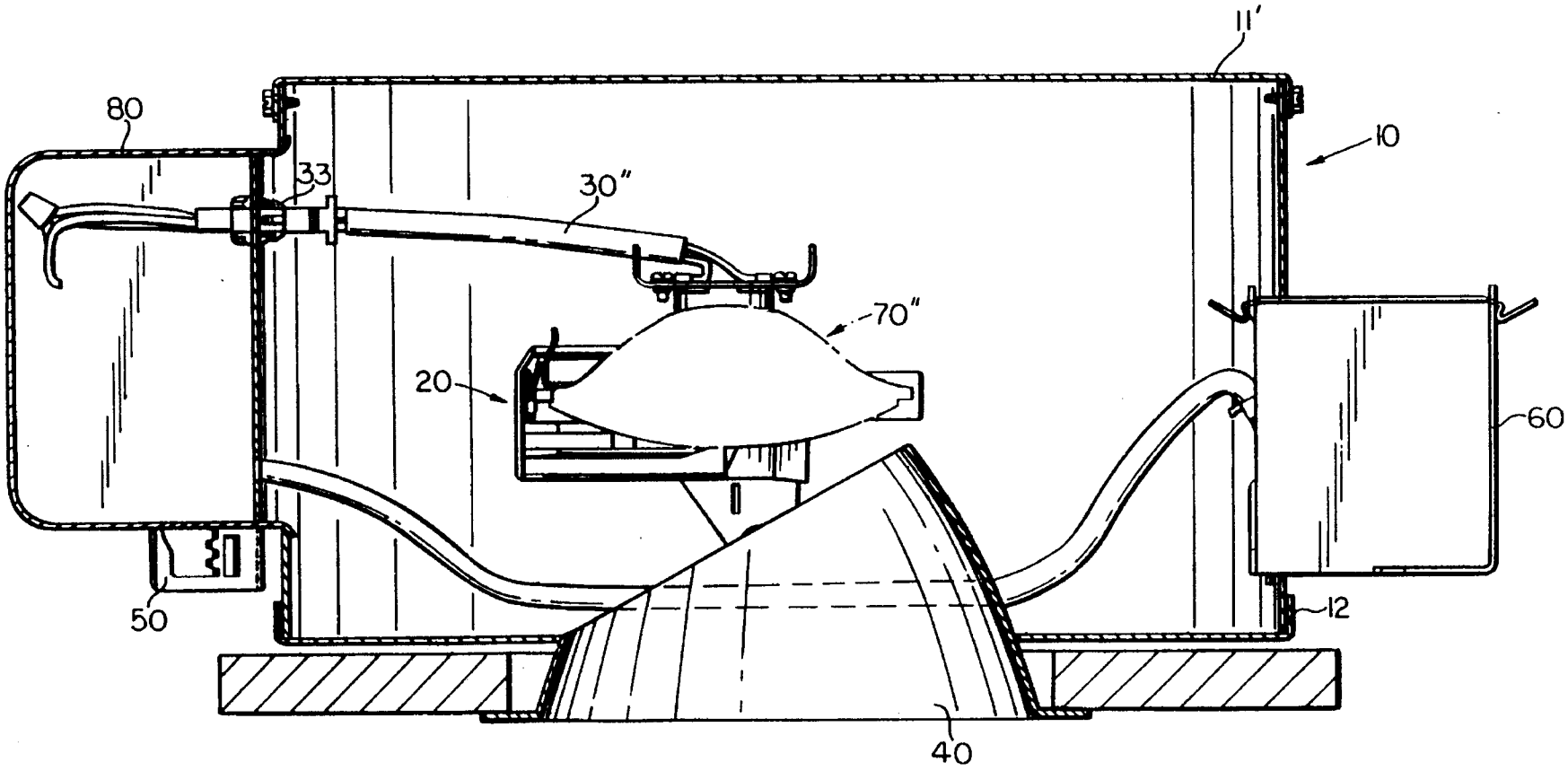
FIG. 4C is a cut-away, side view of a housing shell showing in detail a socket harness assembly detachably attached to an electric power converter via a snap plug, at one end, and a lamp, held by a lampholder, at the other end.

If a socket harness assembly 30' of the type illustrated in FIG. 4A is to be used in place of the type illustrated in FIG. 2, a modular ring holder 32 is required to hold the smaller type of lamp 70'. Furthermore, the leads of socket harness 30' are connected to an electric power converter (not shown) for reduced voltage. FIG. 4C shows another assembly of modular components in an embodiment having a low lamp 70" (shown in phantom lines) which requires a suitable electric power converter, designated here with number 80. Lamp 70" can also be substituted for an H.I.D. lamp (not shown) and the arrangement including electric power converter 80 is just as suitable.

Figure 3A:
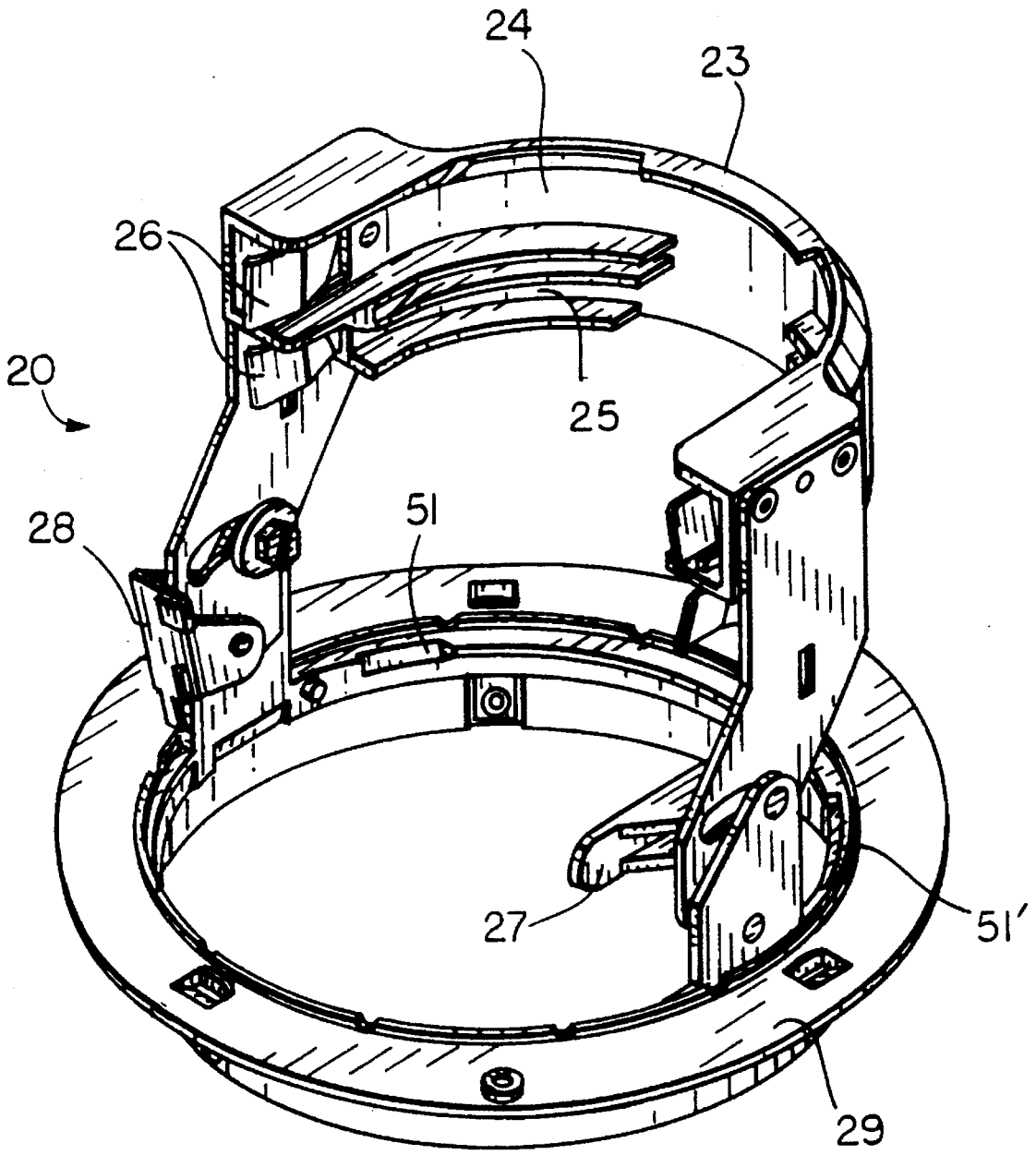
FIGS. 3A–3J show embodiments of the lampholder assembly with FIG. 3A depicting a perspective view of the U-shaped lampholder embodiment.

FIG. 3A is a perspective view of a U-shaped lampholder embodiment generally designated with numeral 20. At the lowermost portion of lampholder 20 is circular horizontal member 29 which contains a horizontal cam feature. The horizontal cam can be rotated in a horizontal plane and fixed at a desired point with lock 28. Horizontal member 29 also comprises at least one notch 51. FIG. 3A shows two notches 51 and 51'. Notches 51 and 51' can engage tension springs such as those designated 52' and 52 depicted in FIGS. 6A and 6B on cones 40' and 40.

Lampholder 20 is primarily of die-cast aluminum and comprises U-shaped member 23. Member 23 is shown with two grooves, groove 24 and groove 25. These grooves are intended for engaging a lamp, a lamp ring and/or accessories. Die-formed steel tension springs 26 are disposed within grooves 24 and 25 for easy snap-in, snap-out, and side mount relamping and attachment of various accessories such as lenses and louvres (see FIG. 9). FIG. 1, in part, shows that the novel horse-shoe shape of member 23 of lampholder 20 once installed into shell 10, provides unobstructed access for ease in side relamping from a position above, from the top of the housing, or from below, through the lower end of the housing.

Figure 3B:
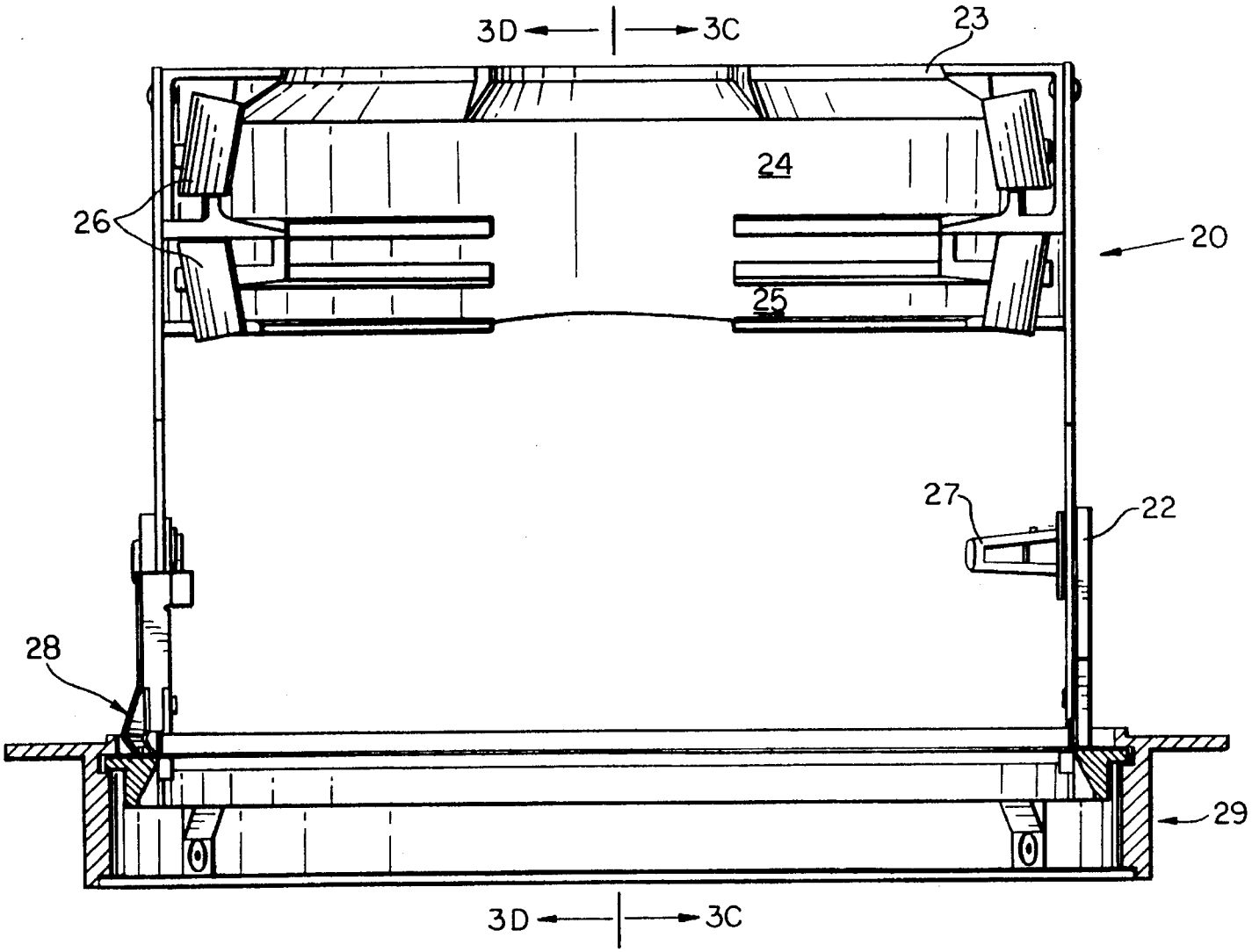
Figure 3C:
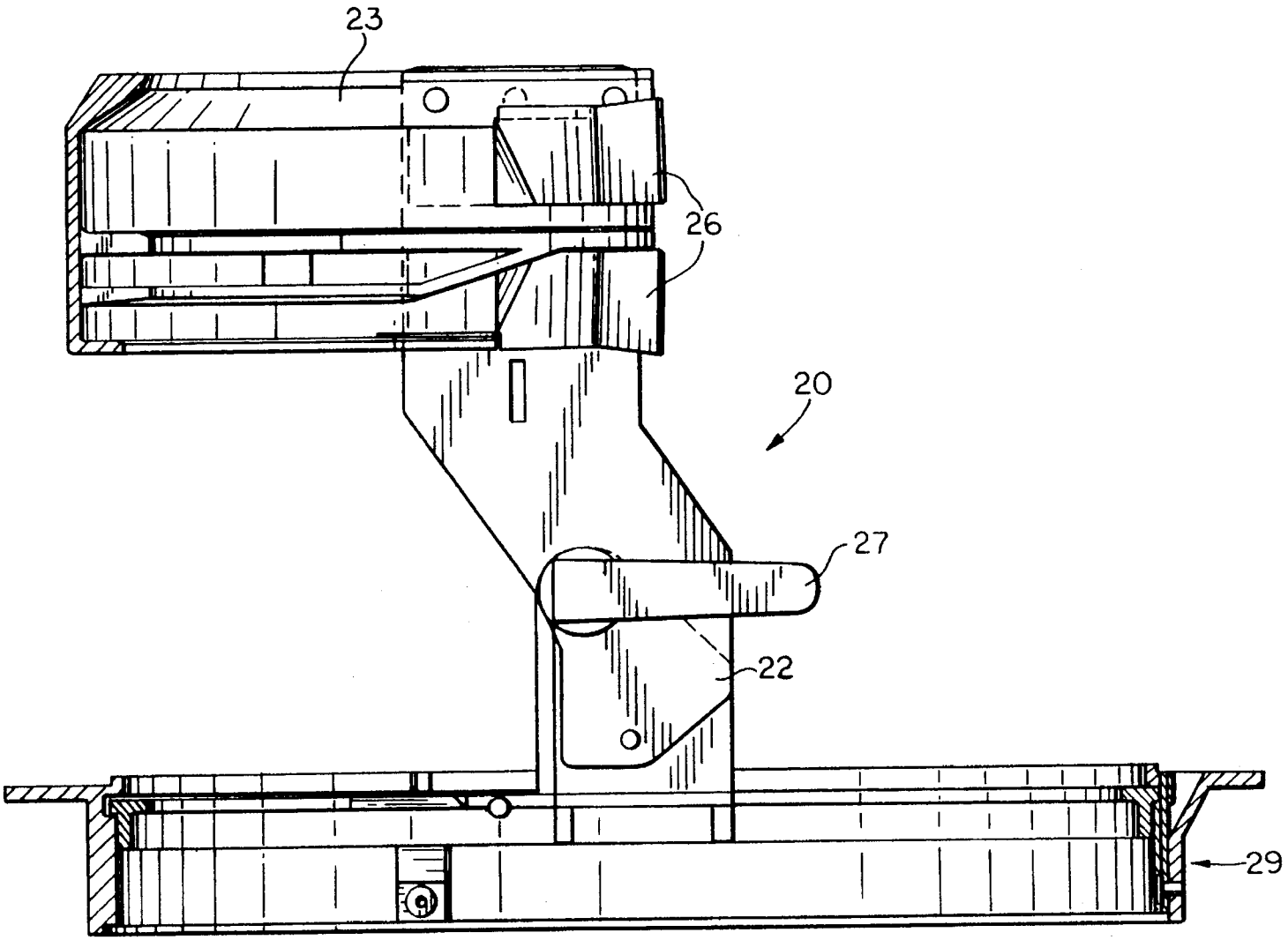
Figure 3D:
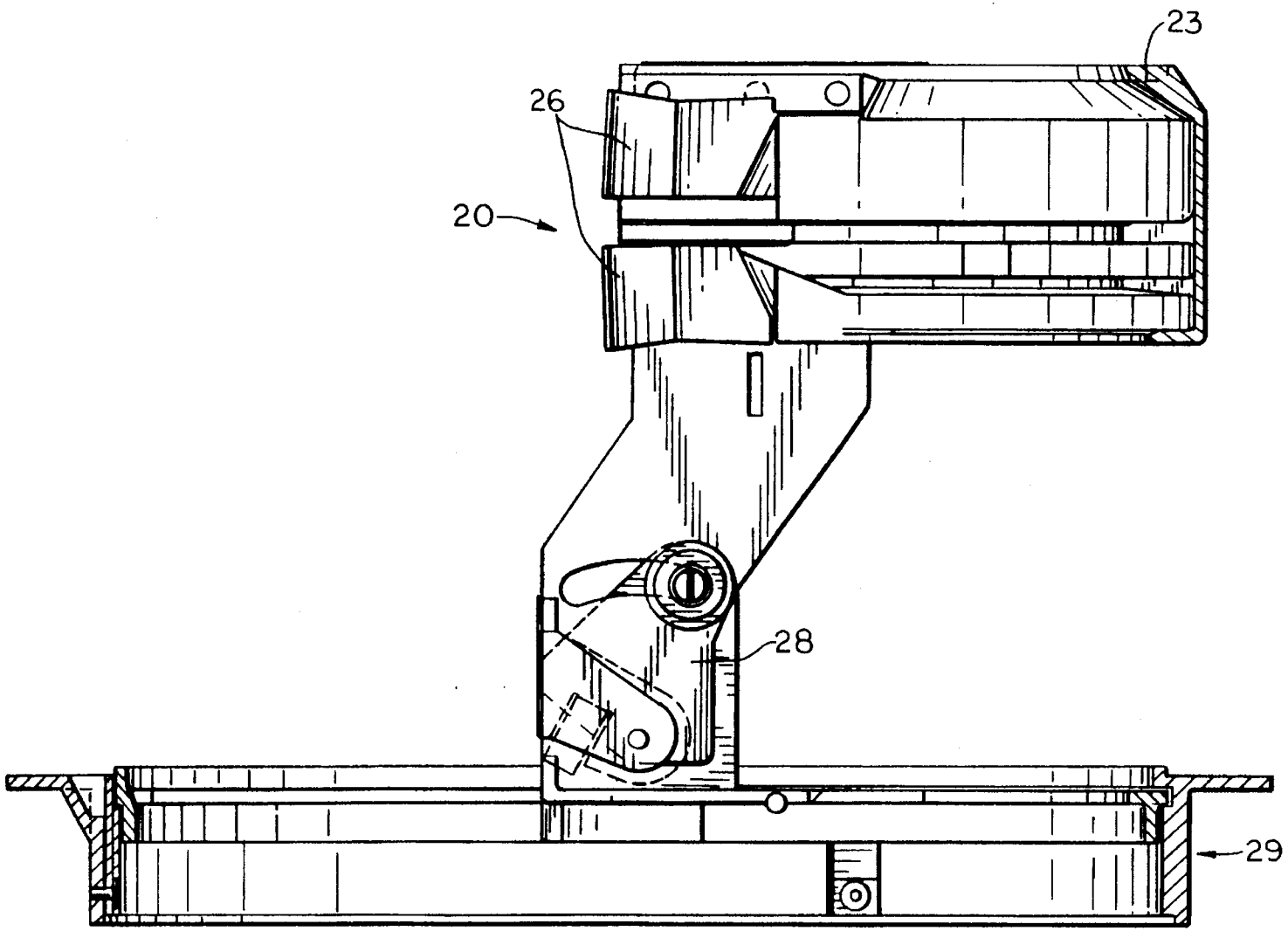

FIG. 3B is a front view of the U-shaped lampholder 20 shown in FIG. 3A. Circular horizontal member 29 is depicted in a cut-away view showing the horizontal cam feature. FIG. 3C gives a side, cut-away view of the lampholder shown in FIG. 3B seen from line 3C—3C. The cut-away exposes vertical cam lock 22. FIG. 3D is a side view of the embodiment in FIG. 3B, with a cut-away view of the horizontal cam seen from line 3D—3D in FIG. 3B.

Figure 3E:
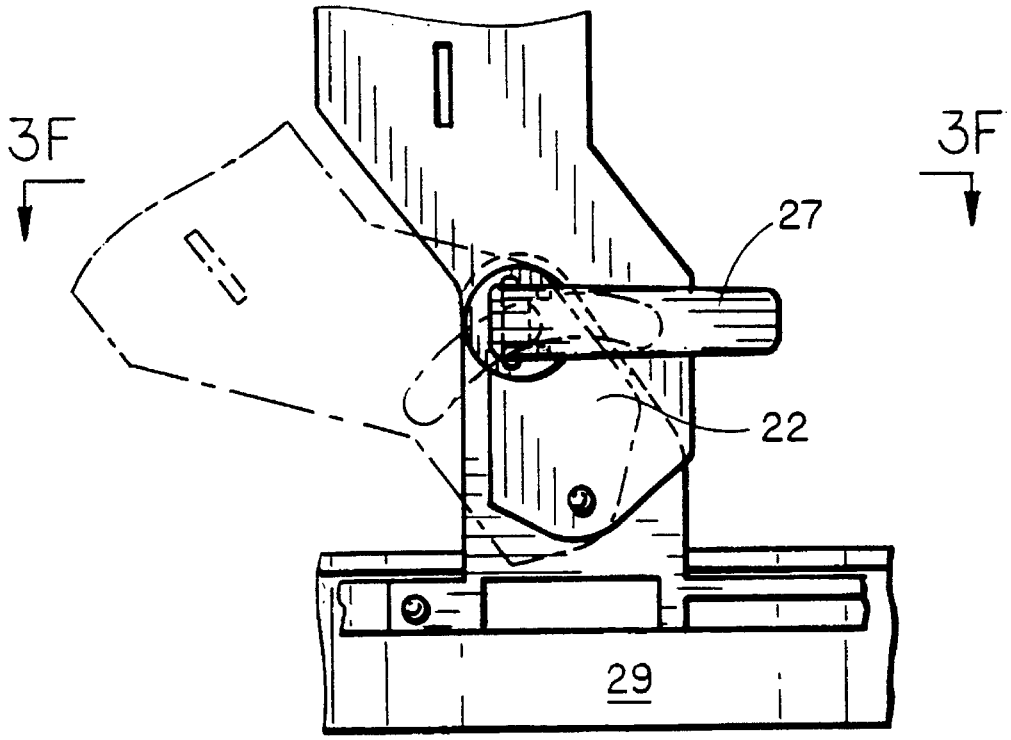
Figure 3F:
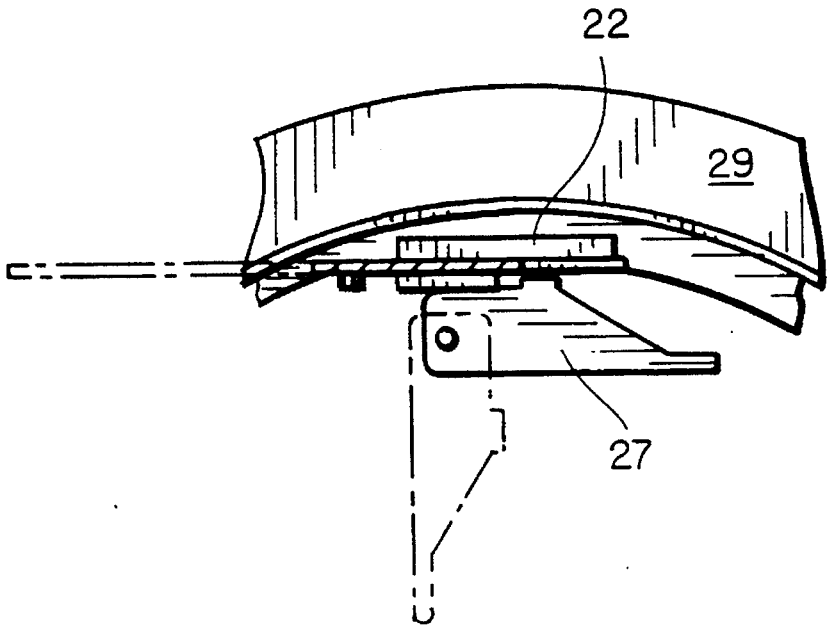

FIG. 3E shows an isolated side view of vertical cam lock 22 showing the tilt mechanism depicted with a vertical member shown superimposed in phantom lines. FIG. 3F shows a bird's-eye view of vertical cam lock 22 seen from line 3F—3F in FIG. 3E. Vertical cam lock 22 allows for up to 45 degrees of vertical tilt adjustment which is locked in place with finger knob 27 once the desired tilt angle is achieved. Vertical cam lock 22 is preferably of a die-cast aluminum lever for providing cam action vertical adjustment and lock.

Figure 3G:
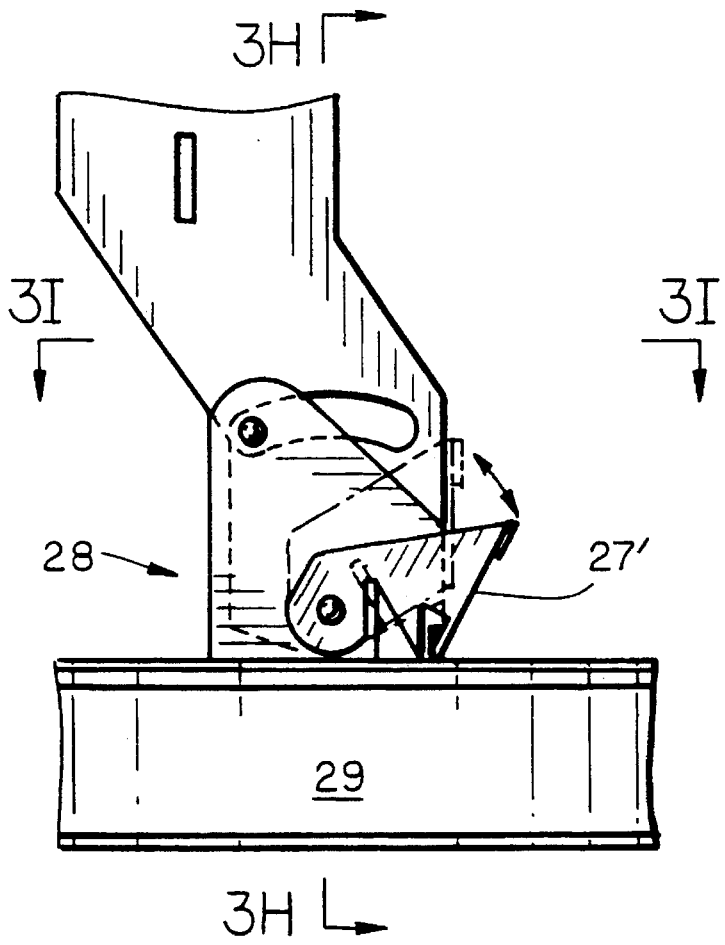
Figure 3H:
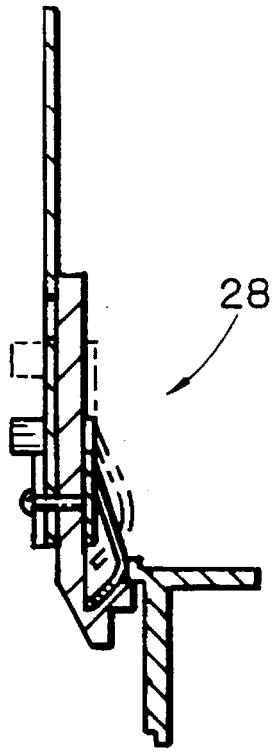
Figure 3I:
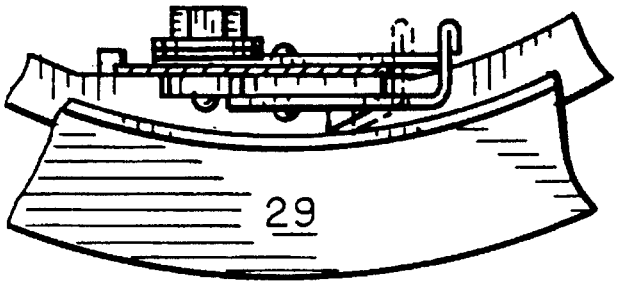

FIG. 3G depicts an isolated side view of horizontal cam lock 28. FIG. 3H shows a cut-away view of horizontal cam lock 28 seen from line 3H—3H in FIG. 3G, and FIG. 3I shows a bird's-eye view of horizontal cam lock 28 seen from line 3I—3I in FIG. 3G. Horizontal cam lock 28 allows for up to 358 degrees of horizontal rotational adjustment. Preferably, the horizontal locks are operated with finger locking knob 27'. Horizontal cam lock 28 is preferably a spring steel lever for providing cam action horizontal adjustment and lock. Both the vertical and horizontal adjustments once made, remain locked while relamping.

Referring to FIGS. 5A and 5B, the preferred horse-shoe lampholder embodiment 20 and truncated cone 40 are shown by way of example to explain the novel off-set pivot mechanism for proper beam alignment. FIG. 5A illustrates that the center of the beam of light (designated with letter "C") provided by lamp 70, is offset laterally from the physical center (designated with letter "A") of reflector cone 40. The inherent design of preferred horse-shoe lampholder embodiment 20 allows for the engagement of a lamp such as 70 to be laterally offset from the center of the cone such as 40.

FIG. 5A shows the vertical angle of lamp 70 relative to cone 40 to be 0 degrees. At this angle, maximum light from lamp 70 passes through the truncated, upper circular opening of cone 40. Consequently, maximum light also passes through the lower circular opening of cone 40 for enhanced lighting of the intended target.

FIG. 5B illustrates that the center of the beam of light C provided by tilted lamp 70 at a maximum pivot angle of 45 degrees intersects the center (designated with letter "B") of the lower circular opening of truncated reflector cone 40. This again allows maximum light from lamp 70 to be concentrated on its target through cone 40 at a 45 degree vertical tilt. Thus, maximum light is provided from 0 through 45 degrees of vertical tilt. Up to 358 degrees of horizontal rotational adjustment provided by the horizontal cam locking mechanism allows for additional directional adjustment.

Figure 3J:
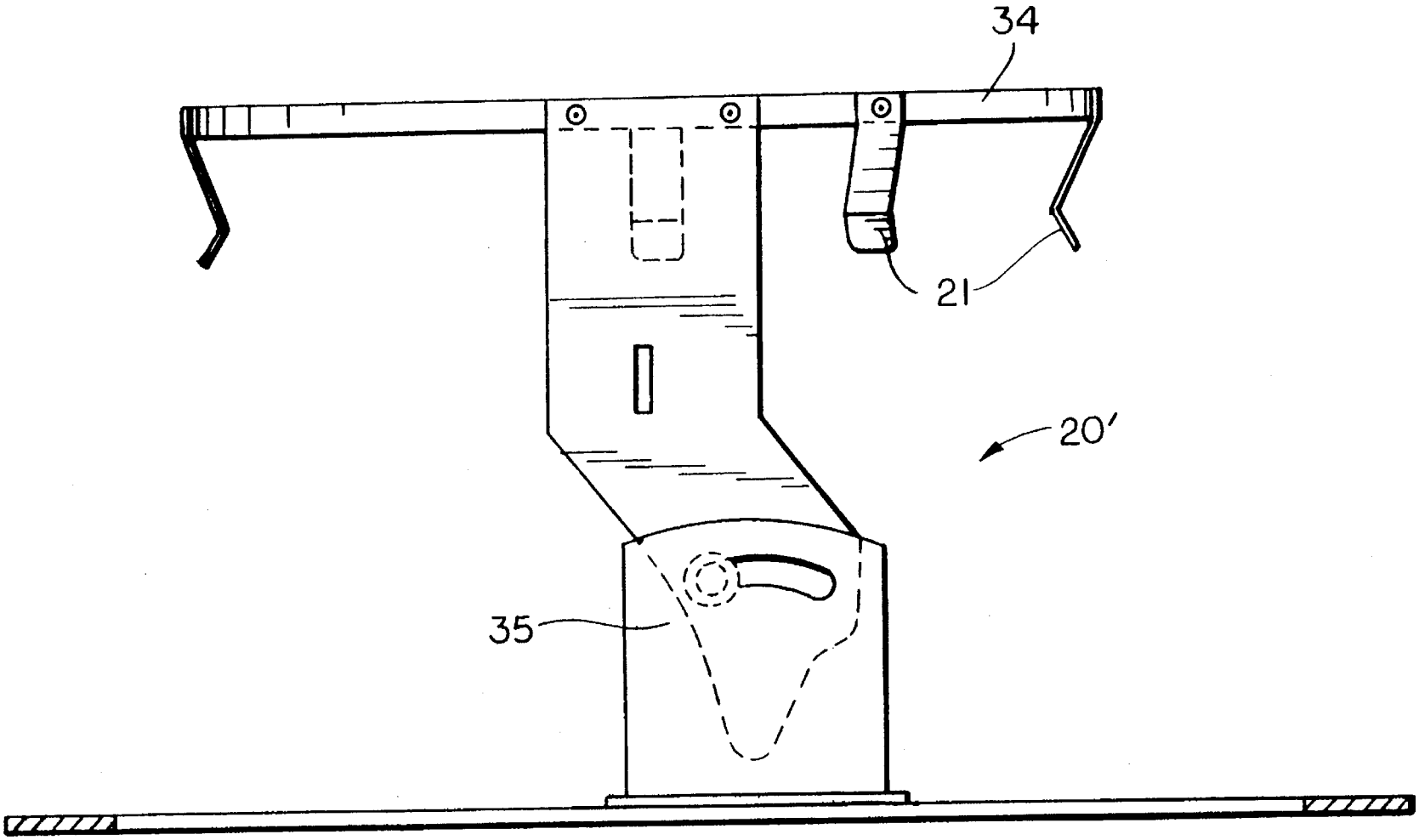

Referring to FIG. 3J, another embodiment of the lampholder assembly 20' is shown. The circular-shaped holder 34 provides downwardly extending die-formed steel tension springs 21 which allow easy snap-in, snap-out mounting and relamping of lamps, lamp rings and accessories. Springs 21 also hold and center the lamp to the aperture at the lower end of the housing shell. The version shown in FIG. 3J is adjustable with thumbscrew lock 35 (drawn in phantom lines) for lamp beam directional adjustments.

FIG. 7A shows two components of a specialized lens wall-washer reflector trim with parts 90 and 91. Part 90 comprises a U-shape member 20' having at least one tension spring means 26' for interchangeable engagement with a lamp. With known wall-washers, relamping from the top of the recessed fixture is virtually impossible and relamping from the bottom is very difficult. The U-shape provided by the present disclosure allows unobstructed access for easy side relamping even in this wall-washer embodiment.

The component assemblies described herein are interchangeably combined to form a variety of final products for the required applications. The myriad of possibilities of this design provide a multitude of features to meet most of the specification requirements by a lighting specialist. The result is a very flexible product that can easily be converted from one type of light source to another with ease, internally at the manufacturing level or externally at the job site.

While the invention has been fully disclosed, those skilled in the art having the benefit of this specification could adapt the present concepts and develop modifications thereto. All of such adaptations and modifications are contemplated as being within the scope and spirit of the present disclosure.

What is claimed is:

1. A multifunction recessed lighting fixture, comprising;

a housing shell having an aperture defined by a rim disposed therein;

an interchangeable socket harness mounting a first end of a lamp, said socket harness comprised of pre-wired detachable electric connection, said socket harness detachably mounted in said housing shell;

an interchangeable lampholder assembly mounting a second end of said lamp, said lampholder assembly having a lower member with a central opening, said lampholder assembly detachably disposed in said housing shell;

an interchangeable reflector trim mounted to said shell through said aperture defined by Said rim and through said central opening in said lower member; and wherein said interchangeable lampholder assembly has an offsetting mechanism comprised of a lamp-holding member designed to hold said lamp offset laterally and parallely from a physical center of said reflector trim such that a center of a beam of light emitted from said lamp is offset laterally from the physical center of said reflector trim.

2. The multifunction recessed lighting fixture of claim 1 wherein:

said interchangeable reflector trim is a cone having a first and a second circular openings, said first circular opening being truncated; and said lampholder assembly further comprises a vertical pivot mechanism having a vertical cam lock which allows from 0 to about 45 degrees of vertical tilt adjustment of said lamp relative to said center of said reflector trim such that maximum beam of light passes through said truncated, first circular opening when said adjustment is at a vertical angle of 0 degrees and maximum beam of light passes said second circular opening when said adjustment is at a vertical angle of 45 degrees.

3. The multifunction recessed lighting fixture of claim 2 wherein said lampholder assembly is further comprised of a U-shape member having at least one U-shape groove disposed therein, said at least one U-shaped groove having at least one tension spring means for interchangeable engagement with a component selected from a group consisting of a lamp, a lamp ring, a screen, a color filter, a louvre and a lens.

4. The multifunction recessed lighting fixture of claim 3 wherein said U-shape member provides unobstructed access for easy side relamping without adjusting focus at any angle of said adjustment.

5. The multifunction recessed lighting fixture of claim 1 wherein said interchangeable lampholder assembly further comprises a circular horizontal member having a horizontal cam, said horizontal cam capable of 358 degrees of rotational adjustment of said lamp mounted to said lampholder assembly, and wherein said circular horizontal member of said lampholder assembly is further comprised of at least one notch, and wherein said interchangeable reflector trim comprises at least one tension spring for engaging with said notch.

* * * * *